US006177224B1

(12) United States Patent
Imafuku et al.

(10) Patent No.: US 6,177,224 B1
(45) **Date of Patent: *Jan. 23, 2001**

(54) METHOD OF MANUFACTURING ELECTROPHOTOGRAPHIC TONER

(75) Inventors: Tatuo Imafuku; Tadashi Nakamura, both of Nara; Hitoshi Nagahama, Uji; Yoshinori Urata, Kashihara; Yasuharu Morinishi, Tenri; Satoshi Ogawa, Yamatokoriyama, all of (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/010,353

(22) Filed: Jan. 21, 1998

(30) Foreign Application Priority Data

Feb. 19, 1997 (JP) ..... 9-035175

(51) Int. Cl.[7] ..... G03G 9/08
(52) U.S. Cl. ..... 430/137; 430/110; 430/111
(58) Field of Search ..... 430/137, 110, 430/111

(56) References Cited

U.S. PATENT DOCUMENTS 5,364,730 11/1994 Kojima et al. ..... 430/137

FOREIGN PATENT DOCUMENTS 57 002 044 1/1982 (JP) .
63-33698 7/1988 (JP) .
02 061 649 3/1990 (JP) .
02 077 756 3/1990 (JP) .
02 213 856 8/1990 (JP) .

OTHER PUBLICATIONS

Patent & Trademark Office English–Language Translation Of JP 57–2044 (Pub Jan. 1982).*
Caplus Abstract An 1982: 414781 Of JP 57–2044 (Pub Jan. 1982).
Japio Abstract An 82–002044 of JP 57–2044 (Pub Jan. 1982).
Derwent Abstract An 82–12587E Of JP 57–2044 (Pub Jan. 1982).

* cited by examiner

*Primary Examiner*—Janis L. Dote
(74) *Attorney, Agent, or Firm*—David G. Conlin; George W. Neuner; Dike, Bronstein, Roberts and Cushman LLP

(57) ABSTRACT

A method of manufacturing electrophotographic toner according to the present invention includes the step of mixing at least toner particles and an additive for a predetermined mixing time to produce the toner, with the predetermined mixing time being set within a range from a first mixing time, at which chargeability of the toner (which changes according to the duration of mixing of the toner particles and the additive) shows a singular point, through a second mixing time, at which preservation of the toner (which also changes according to the duration of mixing) shows a singular point. By this method, a mixing time which maximizes the effects of the additive can be easily set. Accordingly, using a method simpler than conventional methods, a toner can be obtained which has good characteristics with regard to both chargeability and preservation.

12 Claims, 6 Drawing Sheets

METHOD OF MANUFACTURING ELECTROPHOTOGRAPHIC TONER

FIELD OF THE INVENTION

The present invention relates to electrophotographic toner for use in electrophotographic recording methods adopted by, for example, electrostatic copy machines and laser printers.

BACKGROUND OF THE INVENTION

In the past, electrophotographic methods based on application of the Carlson process have been widely used in image formation using toner. Devices adopting the Carlson process are usually provided with a photoreceptive drum, the surface of which is a photoreceptive layer, around which are provided, in order, a charger, an exposure device, a developer, a transfer device, a fixing device, a cleaner, and a charge eliminator.

The Carlson process will be described below.

In this process, first, in a dark environment, the surface of the photoreceptive drum is given a uniform charge by the charger.

Next, the exposure device projects the image of an original onto the surface of the photoreceptive drum, thus eliminating the charge in the areas onto which the light is projected, and forming an electrostatic latent image on the surface of the photoreceptive drum.

Next, toner from the developer, which has a charge of reverse polarity with respect to the photoreceptive drum, is affixed to the electrostatic latent image, thus forming a visible image in toner.

Then, a recording material such as paper is laid over this visible toner image, which is transferred to the recording material by giving the recording paper a charge of reverse polarity with respect to the toner by corona discharge from the reverse side of the recording material.

The toner image is then fixed to the recording material by means of heat and pressure applied by the fixing device, yielding a permanent image.

Toner which remains on the photoreceptive drum without being transferred to the recording material is removed by the cleaner. The electrostatic latent image on the photoreceptive drum is then eliminated by the static eliminator.

Then, successive image formation can be performed by repeating the foregoing process, beginning with charging of the photoreceptive drum.

Toner used in Carlson-process-based electrophotographic methods performs the function of a colored powder to form a visible image, and the functions of carrying a charge and attachment to the recording material. Since toner performs these multiple functions, it is often difficult for a toner to satisfy each of these functions equally well. Sometimes there are problems with image density, at other times problems with preservation, and so on.

In order to solve these problems, additives are often added to the toner to stabilize properties such as preservation, fluidity, and chargeability.

Japanese Examined Patent Publication No. 33698/1988 (Tokukosho 63-33698) discloses a method of manufacturing a developing agent which aims to make effective use of the various properties of toner by achieving the optimum mix of toner and additives.

Here, the additives are in the form of fine particles, but fine particles of this kind are generally found in the form of large secondary particles formed by aggregation of the fine primary particles. For this reason, attempting to provide a toner with desired characteristics usually becomes a question of how finely the aggregates (secondary particles) of additive can be broken down and uniformly dispersed throughout the toner in the optimum state.

Accordingly, the manufacturing method disclosed above adopts as a standard for the optimum state of uniform dispersal of the additives in the toner a mixing time which is 70% of the mixing time at which chargeability of the toner shows a first order singular point. However, depending on the type of additive, there are cases in which the charging level of the additive is lower than that of the toner particles themselves. For this reason, the aggregates of additive cannot be sufficiently broken down by relying solely on the foregoing indicator, and this may make it impossible to obtain desired characteristics.

SUMMARY OF THE INVENTION

The present invention was created in view of the foregoing problems, and its object is to provide an index for setting a mixing time which maximizes the effects of additives, and to provide a toner with desired characteristics.

In order to achieve the foregoing object, a method of manufacturing electrophotographic toner according to the present invention includes the step of:

mixing at least toner particles and an additive for a predetermined mixing time to produce an electrophotographic toner;

the predetermined mixing time being set within a range from a first mixing time through a second mixing time;

the first mixing time being a mixing time at which chargeability of the electrophotographic toner, which changes according to the duration of mixing of the toner particles and the additive, shows a singular point, and the second mixing time being a mixing time at which preservation of the electrophotographic toner, which also changes according to the duration of mixing, shows a singular point.

In general, chargeability and preservation of a toner change according to a predetermined mixing time, which is the actual duration of mixing of toner particles and additives at the time of manufacture. Accordingly, the foregoing method achieves the optimum balance between chargeability and preservation by means of the simple method of adjusting the mixing time so that it is within a range from a first mixing time, at which toner chargeability shows a singular point, through a second mixing time, at which toner preservation shows a singular point.

In other words, the first and second mixing times are used as indices for setting the predetermined mixing time. In this way, by achieving good chargeability, a toner having superior characteristics with regard to image density, fogging density, and scattering can be easily obtained.

Furthermore, by also achieving good preservation, the toner obtained shows little blocking even after a long period of storage, and has superior fluidity. Accordingly, by setting the predetermined mixing time within a range from the first mixing time, at which chargeability shows a singular point, through the second mixing time, at which preservation shows a singular point, a toner with balanced improvement of characteristics with regard to image density, scattering, fogging density, and fluidity can be provided.

In order to achieve the object mentioned above, another method of manufacturing electrophotographic toner according to the present invention includes the steps of:

preparing a mixture of materials by mixing a composite of materials containing at least a binding agent, a pigment, and a charge control agent;

preparing a melted, kneaded mixture by melting and kneading the mixture of materials;

performing grinding classification of the melted, kneaded mixture to obtain toner particles having a predetermined particle diameter; and adding at least an additive to the toner particles and mixing for a predetermined mixing time to produce an electrophotographic toner;

the predetermined mixing time being set within a range from a first mixing time through a second mixing time;

the first mixing time being a mixing time at which chargeability of the electrophotographic toner, which changes according to the duration of mixing of the toner particles and the additive, shows a singular point, and the second mixing time being a mixing time at which preservation of the electrophotographic toner, which also changes according to the duration of mixing, shows a singular point.

Setting the toner particle materials and manufacturing method as specified in the foregoing method results in further improvement of the effect obtained when the predetermined mixing time is set as specified above, namely, balanced improvement of characteristics with regard to image density, scattering, fogging density, and fluidity.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 1(*b*) is a graph showing the relation between mixing time and toner preservation; and FIG. 1(*c*) is a graph showing both the relation between mixing time and chargeability and that between mixing time and preservation.

DESCRIPTION OF THE EMBODIMENTS

The following will explain one embodiment of the present invention in reference to the drawings.

The electrophotographic toner (hereinafter referred to as "toner") according to the present embodiment is made up of toner particles composed of a colorant such as carbon black, a charge control agent, and a mold release agent such as wax integrally attached to the surface of a binding agent (binder), with additives externally attached to these toner particles. In the present embodiment, as will be discussed in detail below, the additive used is a substance with a charging level lower than that of the toner particles.

When toner particles and additive are mixed and dispersed by stirring in a device such as a mixer, the additive, which is in the form of secondary aggregates in the initial stage of the stirring, is gradually broken down and externally attached to the surface of the toner particles. At this time, the size of the additive particles and the state of their attachment to the surface of the toner particles are closely involved in chargeability and preservation of the toner.

Here, the transition in toner chargeability and preservation according to stirring time will be explained with reference to FIGS. 1 and 2.

Chargeability

1. Initial Stage of Stirring

Figure 1:
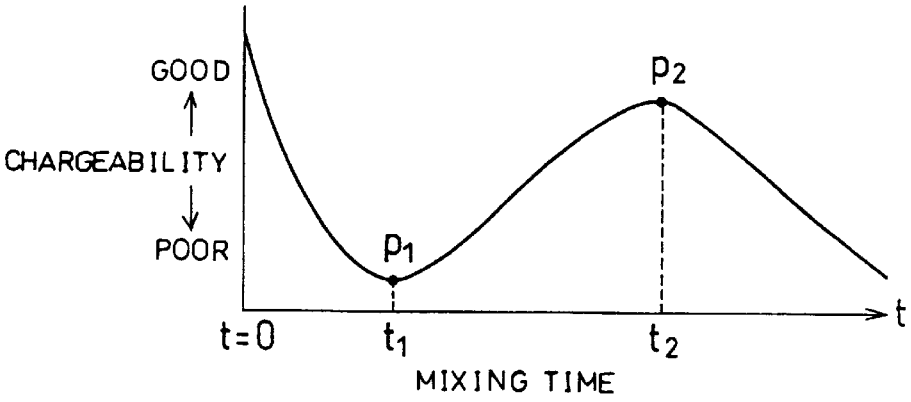
FIG. 1(*a*) is a graph showing the relation between time of mixing of toner particles and additives during the toner manufacturing process and toner chargeability.
Figure 1:
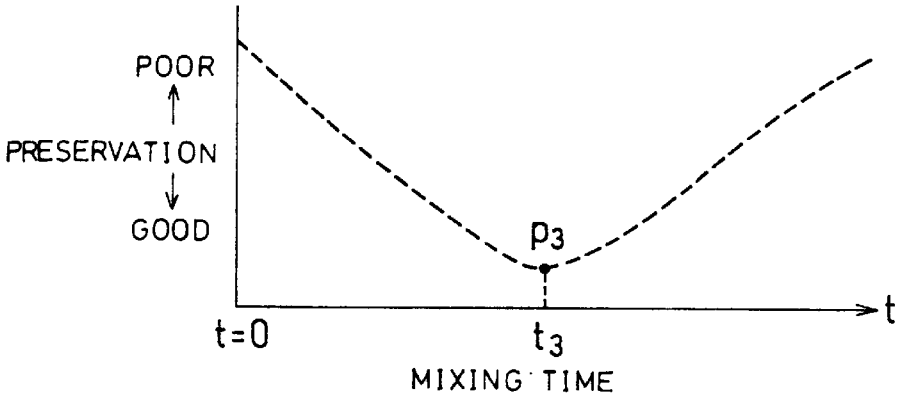
Figure 1:
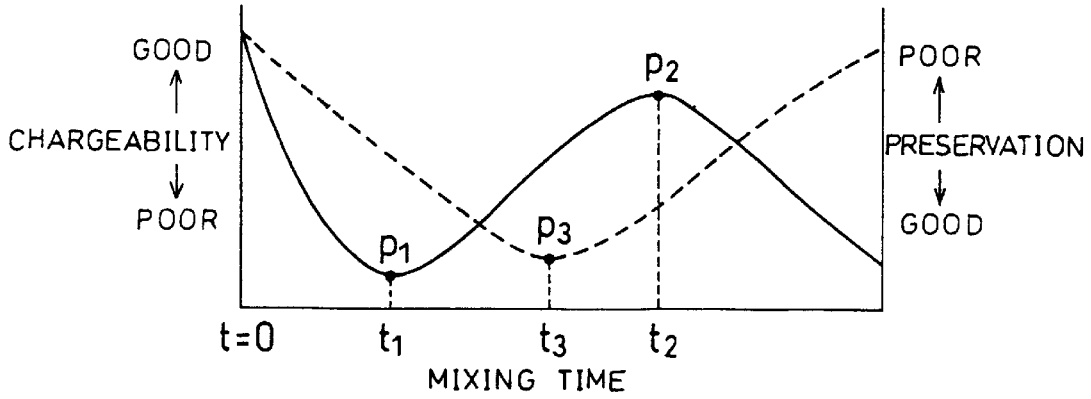
Figure 2A:
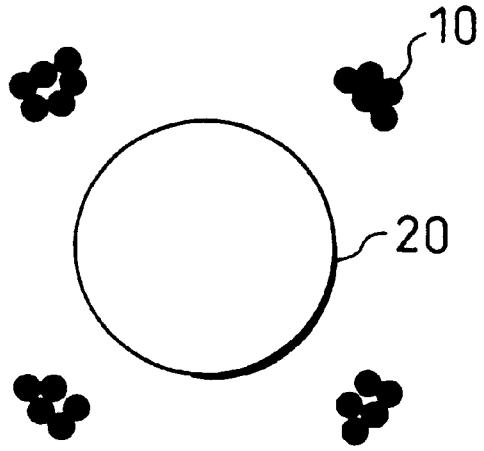
FIGS. 2(*a*), 2(*b*), and 2(*c*) are schematic diagrams showing how an additive becomes externally attached to a toner particle in accompaniment with stirring, with FIG. 2(*a*) showing the initial stage of stirring, FIG. 2(*b*) showing the intermediate stage of stirring, and FIG. 2(*c*) showing the final stage of stirring.
Figure 2B:
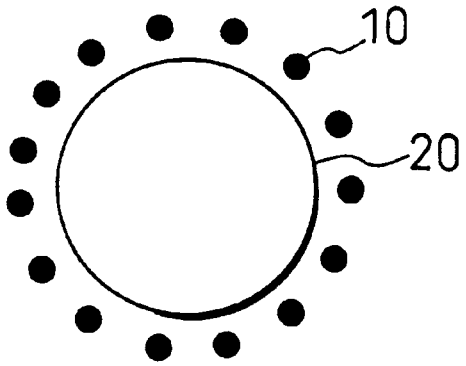
Figure 2C:
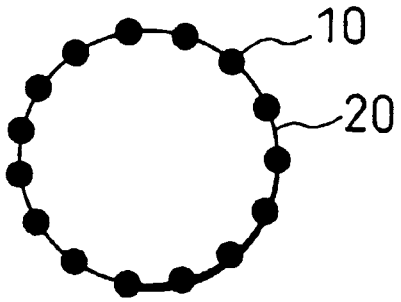

In the initial stage of stirring, as shown in FIG. 2(*a*), additive particles 10 exist as aggregates with low chargeability, which are separated from a toner particle 20. The charging level of the toner particles alone corresponds to that before stirring, shown in FIG. 1(*a*) at mixing time t=0. Since, as mentioned above, the charging level of the additive particles 10 is lower than that of the toner particles 20, the chargeability of the whole gradually decreases in accompaniment with stirring, until it reaches a first order singular point (minimum value) $p_1$ at mixing time $t=t_1$.

2. Intermediate Stage of Stirring

As shown in FIG. 2(*b*), the additive particles 10 are gradually broken down, and begin to be attached to the surface of the toner particle 20. For this reason, chargeability gradually increases, reaching a second order singular point (maximum value) $p_2$ at mixing time $t=t_2$. Hereinafter, this mixing time $t_2$ will be referred to as the first mixing time.

3. Final Stage of Stirring

As shown in FIG. 2(*c*), due to increasingly strong stirring energy, the additive particles 10 become embedded in the surface of the toner particle 20. For this reason, fluidity of the toner decreases, as does its chargeability.

Preservation

1. Initial Stage of Stirring

As shown in FIG. 1(*b*), stirring gradually improves preservation of the mixture, in comparison to that of toner alone, but since the number of additive particles 10 attached to the surface of the toner particle 20 is still small, this effect is not very pronounced.

2. Intermediate Stage of Stirring

As shown in FIG. 2(*b*), the aggregates of the additive particles 10 are gradually broken down, and begin to be attached to the surface of the toner particle 20. As shown in FIG. 1(*b*), preservation is further improved in accompaniment with stirring, until the singular point $p_3$, when preservation is optimum, is reached at mixing time $t=t_3$. Hereinafter, this mixing time $t_3$ will be referred to as the second mixing time.

3. Final Stage of Stirring

As shown in FIG. 2(*c*), due to increasingly strong stirring energy, the additive particles 10 become embedded in the surface of the toner particle 20. For this reason, the effects of the additive particles 10 are impaired, and, as shown in FIG. 1(*b*), preservation also decreases.

In the present embodiment, optimum toner chargeability or preservation, or a balance between the two, can be achieved by controlling the mixing time giving consideration to the different tendencies of these physical quantities (chargeability and preservation) according to mixing time.

In other words, as is clearly shown by FIG. 1(*c*), if the actual duration t of mixing of the toner particles and additives at the time of manufacture (hereinafter referred to as the "predetermined mixing time") is set at the second mixing time ($t=t_3$), when toner preservation is optimum, the state of stirring of the toner particles 20 and the additive particles 10 will be a state midway between the initial stage shown in FIG. 2(*a*) and the intermediate stage shown in FIG. 2(*b*). Accordingly, optimum preservation can be achieved, thus providing a toner having superior fluidity even after a long period of storage.

Again, if the predetermined mixing time t is set at the first mixing time ($t=t_2$), when toner chargeability is optimum, the state of stirring of the toner particles 20 and the additive particles 10 will be that of the intermediate stage shown in FIG. 2(*b*). Accordingly, optimum chargeability can be achieved, and a toner can be provided which is not prone to fogging or scattering.

Alternatively, if the predetermined mixing time t is set within a range between the first and second mixing times ($t_3<t<t_2$), a toner can be obtained which achieves a balance between good chargeability and good preservation.

The toner particles should preferably be produced by melting and kneading, and then performing grinding classification of, a mixture of materials including at least a binding agent, a pigment such as carbon black, and a charge control agent. Further, use of silica for the additive is preferable. If the toner particles and additive are a combination such as the foregoing, the effect of the present invention, namely, provision of a toner with balanced improvement of characteristics with regard to image density, scattering, fogging density, and fluidity, can be further improved.

Next, the present invention will be explained in further detail on the basis of concrete examples and a comparative example. The names of materials, manufacturing conditions, etc. specified in the concrete examples below are examples only, and the present invention is of course not limited to these.

CONCRETE EXAMPLE 1

First, a mixture of materials was prepared by stirring, by weight, 100 parts styrene-acrylic copolymer as a binder resin, 7 parts carbon black (Degussa Co. product Printex 90), 2 parts charge control agent (ORIENT CHEMICAL INDUSTRIES, LTD. product BONTRON P51), and 2 parts polypropylene wax (SANYO CHEMICAL INDUSTRIES, LTD. product TP32) in a dry mixer (a Henschel-type mixer) at 400 rpm. Next, a melted, kneaded mixture was prepared by melting and kneading the mixture of materials in a two-shaft kneading device at 150 rpm. Then, by performing grinding classification of this melted, kneaded mixture in a jet mill, toner particles with an approximate average diameter of 10 $\mu$m were obtained.

To these toner particles was added 0.2 parts by weight of silica (Nippon Aerosil Co., Ltd. product number R972), as additive. Then, the added silica was mixed into the toner particles in the above-mentioned dry mixer, thus producing the toner according to the present example. In the present example, six toners were produced by setting the time of mixing in the additive (mixer revolution time) at 10 seconds, 20 seconds, 30 seconds, 40 seconds, 50 seconds, and 60 seconds.

Incidentally, the charging level of the silica is lower than that of the toner particles.

Figure 3:
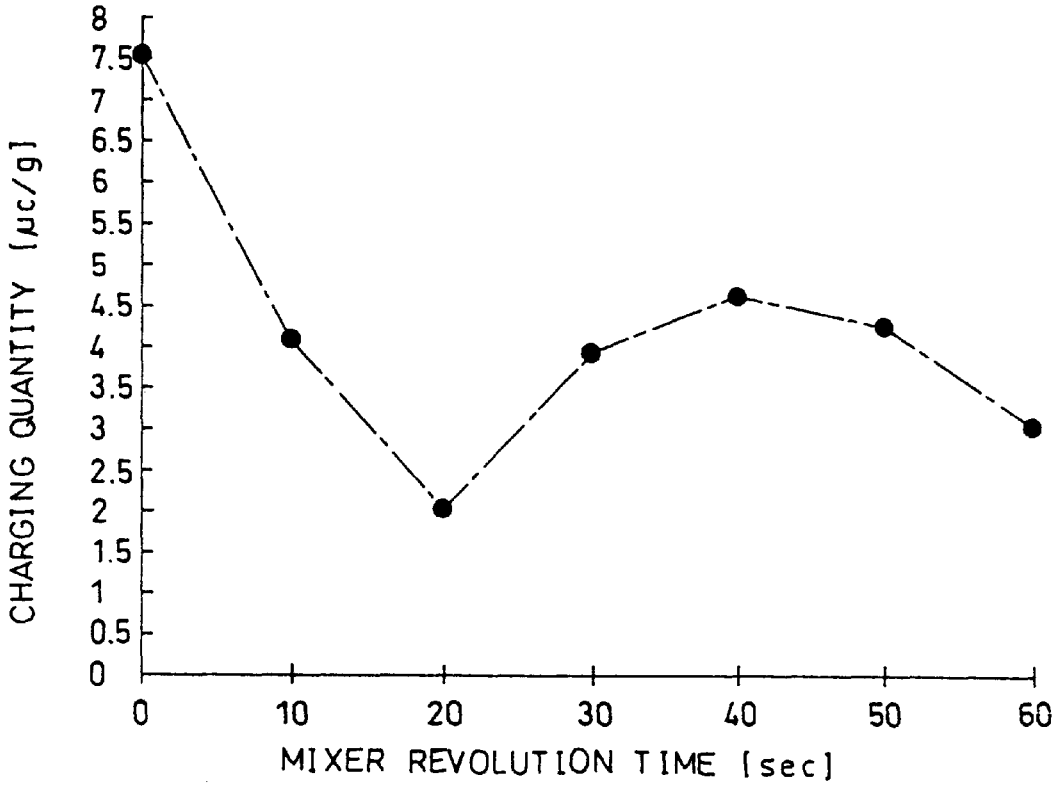
FIG. 3 is a graph showing the relation between time of mixing of toner particles and additives (mixer revolution time) and toner chargeability for a toner according to one embodiment of the present invention.

The results of measurement of the chargeability of each of these toners is shown in FIG. 3. As is clear from FIG. 3, chargeability shows a first order singular point (minimum value) when the time of mixing in the additive (mixer revolution time) is set at 20 seconds, and shows a second order singular point (maximum value) when the mixing time is set at 40 seconds.

Of the six toners, the three produced by setting the mixing time at 20 seconds, 40 seconds, and 60 seconds were evaluated in actual use in a Sharp SF2027 electrostatic copy machine. The items evaluated were image density, fogging density, and quantity of toner scattering. The conditions of measurement, etc. for each of these three items were as follows.

Copying was performed immediately after filling the above-mentioned copy machine with a toner according to the present example, and image density and fogging density were measured by measuring the density of applied toner within and immediately surrounding a test area 55 mm in diameter using a reflection density meter manufactured by Macbeth Co. Incidentally, image density of not less than 1.33 and fogging density of not more than 1.10 are preferable.

Next, the presence of toner scattering within the copy machine after successive copying of 5000 sheets was checked by visually checking each end of the developer layer and the paper guide directly below the developer. Toner scattering was evaluated by assignment to one of the following ranks.

○: No appreciable toner scattering observed.

Δ: Some toner scattering observed, but within an acceptable range.

: A great amount of toner scattering observed.

The results of the three above-mentioned toner evaluations are shown in Table 1.

TABLE 1

| MIXING TIME [sec] | CHARGING QUANTITY [$\mu$c/g] | IMAGE DENSITY [-] | FOGGING DENSITY [-] | TONER SCATTERING QUANTITY [-] |
|---|---|---|---|---|
| 20 | 2.0 | 1.452 | 5.54 | X |
| 40 | 4.7 | 1.455 | 0.55 | ○ |
| 60 | 3.2 | 1.456 | 2.32 | Δ |

As is clear from Table 1, a toner having good characteristics with regard to each of the evaluated items of image density, fogging density, and quantity of toner scattering can be obtained by setting the predetermined mixing time at the time (40 seconds) when chargeability shows a second order singular point (maximum value), i.e., at the first mixing time. As is shown above, a toner not prone to fogging or scattering can be provided by setting the predetermined mixing time at the first mixing time.

CONCRETE EXAMPLE 2

Figure 4:
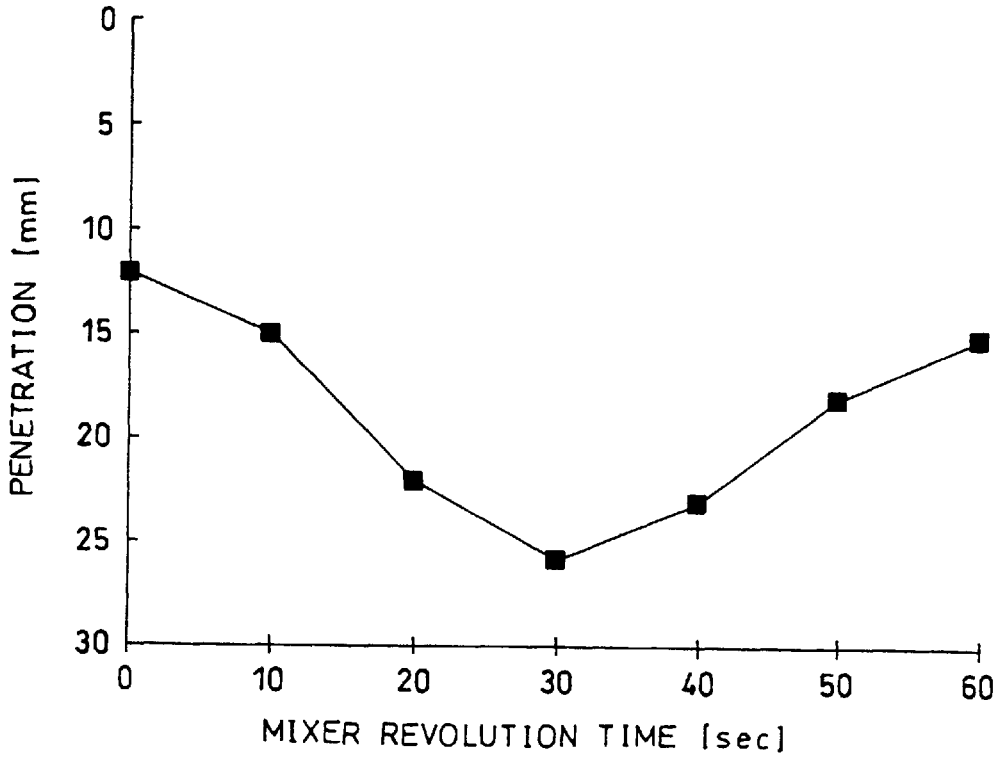
FIG. 4 is a graph showing the relation between mixer revolution time and toner penetration for a toner according to another embodiment of the present invention.

The results of measurement of preservation of the six toners explained in concrete example 1 are shown in FIG. 4. Toner preservation was quantified by measuring penetration of the needle of a Nikka Engineering penetration test device when the needle was introduced perpendicularly into the toner.

Incidentally, penetration of greater than 0 is preferable, and the greater the value, the better the preservation of the toner. As is clear from FIG. 4, penetration shows a first order singular point (maximum value), yielding optimum preservation, when the time of mixing in the additive (mixer revolution time) is set at 30 seconds.

Of the six toners, the three produced by setting the mixing time at 10 seconds, 30 seconds, and 50 seconds were evaluated in actual use. The developing agent used was exclusive to this copy machine. The items evaluated, in addition to penetration, were image density, fogging density, and fogging density after standing. Fogging density after standing was the fogging density when copying was performed after letting the toner stand for 12 hours, and was evaluated by assignment to one of three ranks based on comparison with a criteria sample (image sample).

The results of the three above-mentioned toner evaluations are shown in Table 2.

TABLE 2

| MIXING TIME (sec) | PENETRATION [mm] | IMAGE DENSITY [-] | FOGGING DENSITY [-] | FOGGING DENSITY AFTER STANDING [-] |
|---|---|---|---|---|
| 10 | 15 | 1.452 | 5.54 | X |
| 30 | 25 | 1.455 | 0.55 | ○ |
| 50 | 17 | 1.456 | 0.65 | X |

As is clear from Table 2, a toner having good characteristics with regard to each of the evaluated items of image density, fogging density, and fogging density after standing can be obtained by setting the predetermined mixing time at the time (30 seconds) when penetration shows a singular point (maximum value), i.e., at the second mixing time.

In this example, optimum toner preservation can be obtained by setting the predetermined mixing time at the mixing time when penetration shows a singular point. Thus, it can be seen that a toner with superior characteristics with regard to image density, fogging density, and fogging density after standing can be provided.

CONCRETE EXAMPLE 3

First, a mixture of materials was prepared by stirring, by weight, 100 parts styrene-acrylic copolymer as a binder resin, 7 parts carbon black (Degussa Co. product Printex 90; oil absorption 95), 2 parts charge control agent (ORIENT CHEMICAL INDUSTRIES, LTD. product BONTRON P51), and 2 parts polypropylene wax (SANYO CHEMICAL INDUSTRIES, LTD. product TP32) in a dry mixer (a Henschel-type mixer) at 400 rpm. Next, a melted, kneaded mixture was prepared by melting and kneading the mixture of materials in a two-shaft kneading device at 150 rpm. Then, by performing grinding classification of this melted, kneaded mixture in a jet mill, toner particles with an average diameter of 10 $\mu$m were obtained.

To these toner particles was added 0.2 parts by weight of silica (Nippon Aerosil Co., Ltd. product number OX50), as additive. Then, the added silica was mixed into the toner particles in the above-mentioned dry mixer, thus producing the toner according to the present example. In the present example, six toners were produced by setting the time of mixing in the additive (mixer revolution time) at 10 seconds, 20 seconds, 30 seconds, 40 seconds, 50 seconds, and 60 seconds.

Figure 5:
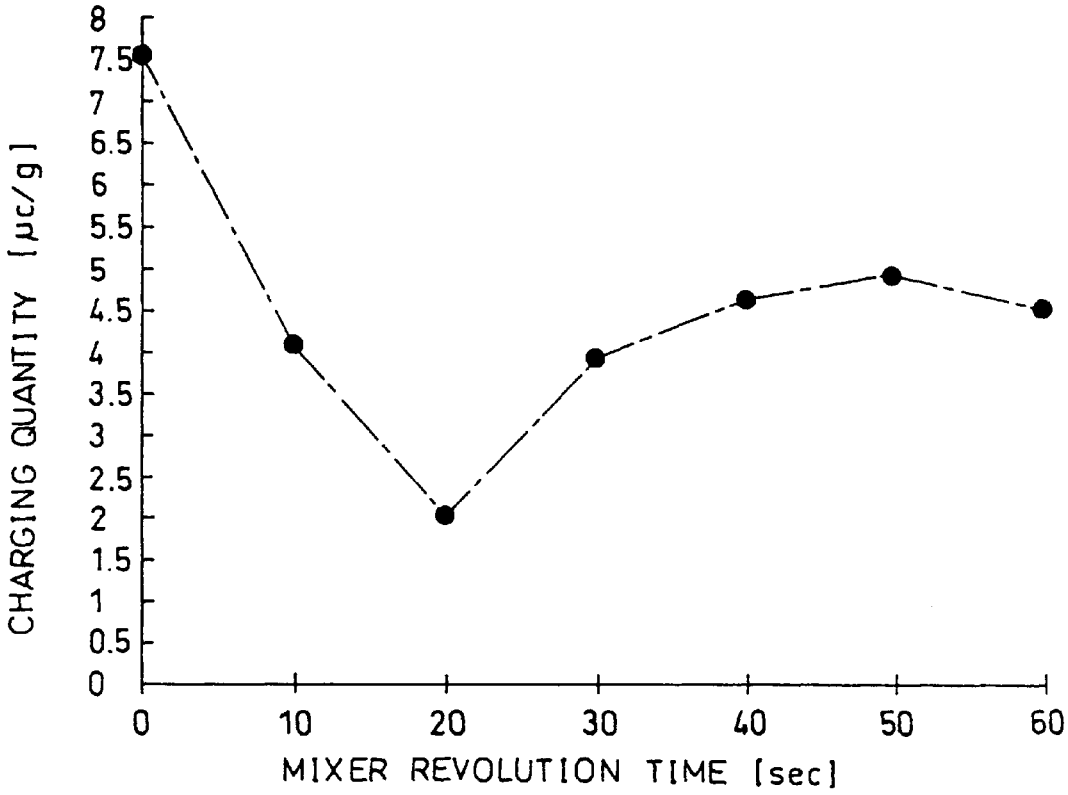
FIG. 5 is a graph showing the relation between mixer revolution time and toner chargeability for a toner according to a further embodiment of the present invention.

The results of measurement of the chargeability of each of these toners is shown in FIG. 5. As is clear from FIG. 5, chargeability shows a second order singular point (maximum value) when the mixing time is set at 50 seconds. In other words, the first mixing time is 50 seconds.

Figure 6:
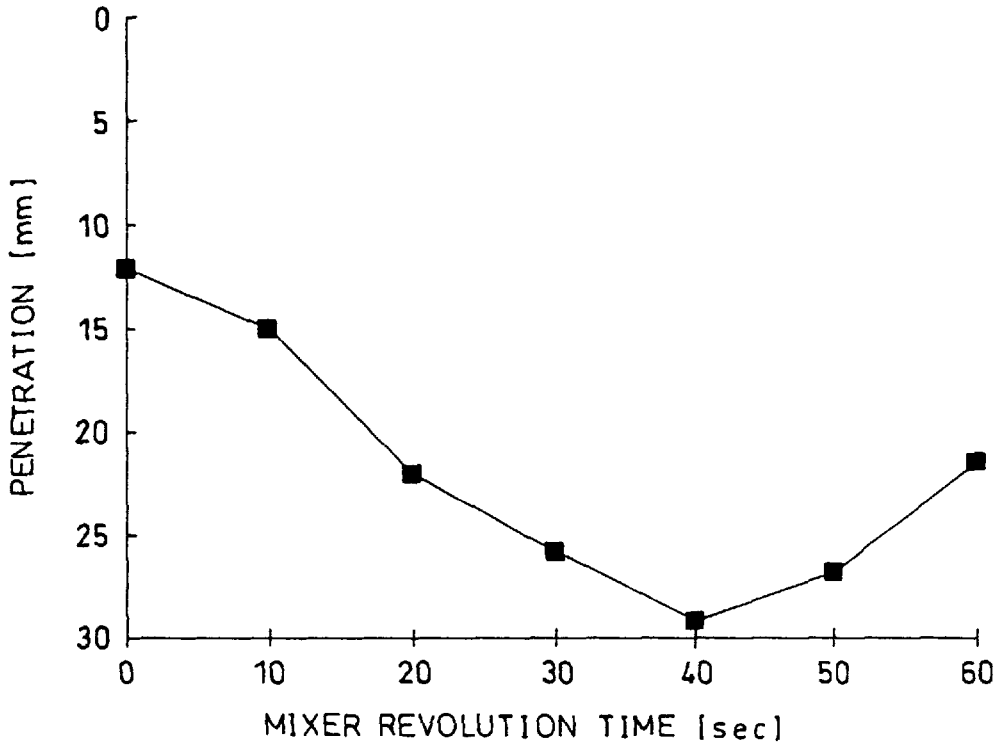
FIG. 6 is a graph showing the relation between mixer revolution time and toner penetration for a toner according to a further embodiment of the present invention.

Next, FIG. 6 shows the results of quantification of toner preservation by measuring penetration in the same way as in concrete example 2. As is clear from FIG. 6, preservation shows a singular point (maximum value) when the mixing time is set at 40 seconds. In other words, the second mixing time is 40 seconds.

Here, as with concrete examples 1 and 2, each of these toners was evaluated with respect to image density, fogging density, fogging density after standing, and quantity of toner scattering. The results of this evaluation are shown in Table 3.

TABLE 3

| MIXING TIME [sec] | CHARGING QUANTITY [$\mu$c/g] | PENETRATION [mm] | IMAGE DENSITY [-] | FOGGING DENSITY [-] | FOGGING DENSITY AFTER STANDING [-] | TONER SCATTERING QUANTITY [-] |
|---|---|---|---|---|---|---|
| 20 | 2.0 | 22 | 1.452 | 5.54 | X | X |
| 30 | 4.0 | 30 | 1.451 | 0.71 | ○ | ○ |
| 40 | 4.6 | 29 | 1.455 | 0.55 | ○ | ○ |
| 50 | 4.4 | 31 | 1.452 | 0.68 | ○ | ○ |
| 60 | 4.6 | 21 | 1.456 | 2.32 | X | Δ |

As is clear from Table 3, a toner having good characteristics with regard to each of the evaluated items can be obtained by setting the predetermined mixing time within a range from the second mixing time (40 seconds) to the first mixing time (50 seconds).

CONCRETE EXAMPLE 4

First, a mixture of materials was prepared by stirring, by weight, 100 parts styrene-acrylic copolymer as a binder resin, 7 parts carbon black (Degussa Co. product PRINTEX 90; oil absorption 95), 2 parts charge control agent (ORIENT CHEMICAL INDUSTRIES, LTD. product BONTRON P51), 2 parts polypropylene wax (SANYO CHEMICAL INDUSTRIES, LTD. product TP32), and x parts magnetite (TITAN KOGYO KABUSHIKI KAISHA product number BL-220) in a dry mixer (a Henschel-type mixer) at 400 rpm. Next, a melted, kneaded mixture was prepared by melting and kneading the mixture of materials in a two-shaft kneading device at 150 rpm. Then, by performing grinding classification of this melted, kneaded mixture in a jet mill, toner particles with an average diameter of 10 μm were obtained.

To these toner particles was added 0.2 parts by weight of silica (Nippon Aerosil Co., Ltd. product number R972), as additive. Then, the added silica was mixed into the toner particles in the above-mentioned dry mixer, thus producing the toner according to the present example. In the present example, five toners A through E were produced by adding the above-mentioned magnetite so that x=1 part, 5 parts, 10 parts, 20 parts, and 50 parts by weight, respectively.

Each of these toners A through E was evaluated with respect to apparent density, charging quantity, penetration, image density, fogging density, and fogging density after standing. The results of this evaluation are shown in Table 4.

TABLE 4

| SAMPLE | APPARENT DENSITY [g/cc] | CHARGING QUANTITY [μc/g] | PENETRATION [mm] | IMAGE DENSITY [-] | FOGGING DENSITY [-] | FOGGING DENSITY AFTER STANDING [-] |
|---|---|---|---|---|---|---|
| TONER A | 0.182 | 2.0 | 16 | 1.452 | 5.54 | X |
| TONER B | 0.200 | 3.9 | 22 | 1.451 | 1.22 | ○ |
| TONER C | 0.321 | 4.7 | 25 | 1.452 | 0.55 | ○ |
| TONER D | 0.800 | 4.4 | 18 | 1.455 | 1.23 | ○ |
| TONER E | 0.820 | 4.1 | 12 | 1.456 | 2.32 | X |

As is clear from Table 4, good characteristics can be obtained when the apparent density of the toner itself is from 0.200 to 0.800.

CONCRETE EXAMPLE 5

A further concrete example of the present invention, along with a comparative example, will be explained below.

First, a mixture of materials was prepared by stirring, by weight, 100 parts styrene-acrylic copolymer as a binder resin, 7 parts carbon black (Degussa Co. product PRINTEX 90; oil absorption 95), 2 parts charge control agent (ORIENT CHEMICAL INDUSTRIES, LTD. product BONTRON P51), and 2 parts polypropylene wax (SANYO CHEMICAL INDUSTRIES, LTD. product TP32) in a dry mixer (a Henschel-type mixer) at 400 rpm. Next, a melted, kneaded mixture was prepared by melting and kneading the mixture of materials in a two-shaft kneading device at 150 rpm. Then, by performing grinding classification of this melted, kneaded mixture in a jet mill, toner particles with an average diameter of 10 μm were obtained.

To these toner particles was added y percent by weight of silica (Nippon Aerosil Co., Ltd. product number R972), as additive. Then, the added silica was mixed into the toner particles in the above-mentioned dry mixer for 30 seconds, thus producing the toner according to the present example. In the present example, five toners F through J were produced by adding the above-mentioned silica so that y=0% (comparative example), 0.2%, 1.0%, 5.0%, and 6.0% by weight, respectively.

Each of these toners F through J was evaluated with respect to charging quantity, penetration, image density, fogging density, and fogging density after standing. The results of this evaluation are shown in Table 5.

TABLE 5

| SAMPLE | ADDITIVE AMOUNT [wt %] | CHARGING QUANTITY [μc/g] | PENETRATION [mm] | IMAGE DENSITY [-] | FOGGING DENSITY [-] | FOGGING DENSITY AFTER STANDING [-] |
|---|---|---|---|---|---|---|
| TONER F | NONE | 7.5 | 12 | 1.285 | 1.25 | X |
| TONER G | 0.2 | 4.0 | 25 | 1.452 | 0.55 | ○ |
| TONER H | 1.0 | 4.0 | 25 | 1.452 | 6.21 | Δ |
| TONER I | 5.0 | 4.0 | 26 | 1.455 | 6.22 | Δ |
| TONER J | 6.0 | 1.2 | 28 | 1.456 | 12.32 | X |

As is clear from Table 5, characteristics are impaired if the silica added exceeds 5.0% by weight. Accordingly, it is preferable if the amount of additive added is more than 0% but not more than 5.0% by weight.

As discussed above, in the method of manufacturing electrophotographic toner according to the present invention, in mixing at least toner particles and an additive for a predetermined mixing time to produce an electrophotographic toner, the predetermined mixing time is set within a range from a mixing time at which toner chargeability (which changes according to the duration of mixing of the toner particles and the additive) shows a singular point (first mixing time) through a mixing time at which toner preservation (which also changes according to the duration of mixing) shows a singular point (second mixing time).

With the foregoing method, the optimum balance between chargeability and preservation can be achieved by means of the simple method of adjusting the mixing time. By achieving good chargeability, a toner having superior characteristics with regard to image density, fogging density, and scattering can be obtained. Further, by achieving good preservation, a toner which shows little blocking even after a long period of storage, and has superior fluidity, can be obtained.

Accordingly, by setting the predetermined mixing time within a range from the first mixing time through the second mixing time, a toner with balanced improvement of characteristics with regard to image density, scattering, fogging density, and fluidity can be easily provided.

Further, in the foregoing method of manufacturing electrophotographic toner, the charging level of the additive is lower than that of the toner particles. When this kind of additive with a low charging level is used, mixing the toner particles and additive initially causes the chargeability of the mixture to gradually decrease, until it reaches a first order singular point (minimum value). This is because aggregates of additive with low chargeability exist separately from the toner particles.

If mixing of the toner particles and additive is continued, the aggregates of additive are gradually broken down, and begin to be attached to the surface of the toner particles. For this reason, chargeability gradually increases, until it reaches a second order singular point (maximum value). In this way, by using an additive with a lower charging level than the toner particles, the first order singular point, when the additive is still not sufficiently broken down, can be clearly grasped. This has the advantage of simplifying setting of an appropriate predetermined mixing time for mixing of the toner particles and additive.

With the foregoing method of manufacturing electrophotographic toner, the predetermined mixing time may be set at the mixing time when chargeability reaches a second order singular point. In this way, by the simple method of adjusting the mixing time, the additive is broken down and appropriately attached to the surface of the toner particles, and a toner can be obtained which has superior characteristics with regard to charging response. In other words, a toner can be provided in which fogging is held to a minimum, and the quantity of scattering is low.

Again, with the foregoing method of manufacturing electrophotographic toner, the predetermined mixing time may be set at the mixing time when preservation reaches a singular point. In this way, by the simple method of adjusting the mixing time, a toner with superior preservation characteristics can be obtained. In other words, a toner can be provided which shows little blocking even after a long period of storage, and has superior fluidity.

Again, with the foregoing method of manufacturing electrophotographic toner, the predetermined mixing time may be set at a mixing time between the time when chargeability reaches a second order singular point and the time when preservation reaches a singular point. In this way, by the simple means of adjusting the mixing time, a toner can be obtained which has good characteristics with regard to both chargeability and preservation. In other words, a toner with balanced improvement of multiple characteristics can be provided, in which, for example, fogging is held to a minimum, the quantity of scattering is low, and superior fluidity is maintained over a long period.

In addition, with the foregoing method of manufacturing electrophotographic toner, the apparent density of the toner may be set within an approximate range from 0.20 g/cc to 0.80 g/cc. Again, the quantity of additive may be set at 5% or less by weight. As a result, the effects of the additive can be maximized.

The embodiments and concrete examples of implementation discussed in the foregoing detailed explanations of the present invention serve solely to illustrate the technical details of the present invention, which should not be narrowly interpreted within the limits of such concrete examples, but rather may be applied in many variations without departing from the spirit of the present invention and the scope of the patent claims set forth below.

What is claimed is:

1. A method of manufacturing an electrophotographic toner, the method comprising the step of:

mixing at least toner particles and an additive for a predetermined mixing time t to produce an electrophotographic toner, wherein:

said predetermined mixing time t is set with chargeability and preservation of said electrophotographic toner, both of which change according to duration of a mixing time of the toner particles and the additive, the preservation being quantified by measuring penetration of a needle of a penetration test device when the needle is introduced perpendicularly into said electrophotographic toner; and let $t_2$ be a first mixing time, at which the chargeability reaches a second order singular point $p_2$ showing a maximum value, and let $t_3$ be a second mixing time, at which the preservation reaches a singular point $p_3$, having a maximum value then said predetermined mixing time t is set within a range, $t_3 \leqq t \leqq t_2$.

2. The method of manufacturing electrophotographic toner set forth in claim 1, wherein:

the additive has a charging level which is lower than that of the toner particles.

3. The method of manufacturing electrophotographic toner set forth in claim 1, wherein:

the predetermined mixing time is set at the first mixing time.

4. The method of manufacturing electrophotographic toner set forth in claim 1, wherein:

the predetermined mixing time is set at the second mixing time.

5. The method of manufacturing electrophotographic toner set forth in claim 1, wherein:

apparent density of the electrophotographic toner is within an approximate range from 0.20 g/cc through 0.80 g/cc.

6. The method of manufacturing electrophotographic toner set forth in claim 1, wherein:

the quantity of the additive added is no more than 5% by weight with respect to the toner particles.

7. The method of manufacturing electrophotographic toner set forth in claim 1, wherein:

the toner particles have an approximate average particle diameter of 10 $\mu$m.

8. The method of manufacturing electrophotographic toner set forth in claim 1, wherein:

the additive is silica.

9. A method of manufacturing an electrophotographic toner, the method comprising the step of:

preparing a mixture of materials by mixing a composite of materials including at least a binding agent, a pigment, and a charge control agent;

preparing a melted, kneaded mixture by melting and kneading the mixture of materials;

performing grinding classification of the melted, kneaded mixture, so as to obtain toner particles having a predetermined particle diameter; and adding at least an additive to the toner particles and mixing for a predetermined mixing time t, so as to produce an electrophotographic toner, wherein:

said predetermined mixing time t is set with chargeability and preservation of said electrophotographic toner, both of which change according to duration of a mixing time of the toner particles and the additive, the preservation being quantified by measuring penetration of a needle of a penetration test device when the needle is introduced perpendicularly into said electrophotographic toner; and let $t_2$ be a first mixing time, at which the chargeability reaches a second order singular point $p_2$ showing a maximum value, and let $t_3$ be a second mixing time, at which the preservation reaches a singular point $p_3$ having a maximum value, then said predetermined mixing time t is set within a range, $t_3 \leqq t \leqq t_2$.

10. The method of manufacturing electrophotographic toner set forth in claim 9, wherein:

the additive has a charging level which is lower than that of the toner particles.

11. The method of manufacturing electrophotographic toner set forth in claim 9, wherein:

the predetermined mixing time is set at the first mixing time.

12. The method of manufacturing electrophotographic toner set forth in claim 9, wherein:

the predetermined mixing time is set at the second mixing time.

* * * * *